US007610712B2

(12) United States Patent
Ertl

(10) Patent No.: US 7,610,712 B2
(45) Date of Patent: Nov. 3, 2009

(54) ADJUSTABLE REAR PISTOL SIGHT

(75) Inventor: Thomas Ertl, Gottmadingen (DE)

(73) Assignee: Keng's Firearms Specialty, Inc., Atlanta, GA (US)

( * ) Notice: Subject to any disclaimer, the term of this patent is extended or adjusted under 35 U.S.C. 154(b) by 497 days.

(21) Appl. No.: 11/638,697

(22) Filed: Dec. 14, 2006

(65) Prior Publication Data

US 2007/0199227 A1 Aug. 30, 2007

Related U.S. Application Data

(60) Provisional application No. 60/750,051, filed on Dec. 14, 2005.

(51) Int. Cl.
*F41G 1/00* (2006.01)

(52) U.S. Cl. ..... 42/137

(58) Field of Classification Search ..... 42/135–139
See application file for complete search history.

(56) References Cited

U.S. PATENT DOCUMENTS

| | | | | |
|---|---|---|---|---|
| 2,162,090 | A * | 6/1939 | King | 42/137 |
| 3,834,035 | A * | 9/1974 | Merrill | 42/133 |
| 4,477,979 | A * | 10/1984 | Oren | 42/137 |
| 4,551,920 | A * | 11/1985 | Mahotra | 42/137 |
| 6,779,290 | B1 * | 8/2004 | Houtsma | 42/148 |
| 7,526,890 | B1 * | 5/2009 | Keng et al. | 42/136 |
| 2006/0207157 | A1 * | 9/2006 | Keng | 42/132 |

* cited by examiner

*Primary Examiner*—J. Woodrow Eldred
*Assistant Examiner*—Gabriel J Klein
(74) *Attorney, Agent, or Firm*—J. A. McKinney, Jr.

(57) ABSTRACT

An adjustable rear pistol sight has a sight base and a sight block. The sight block is secured in a recess in the sight base and has both windage and elevation adjustment capabilities. The sight base has a dovetail that will be receivable in a cooperatively shaped notch in a slide of a pistol with which the adjustable rear sight is intended for use. The sight has no sharp edges or surfaces and is essentially snag-free.

20 Claims, 5 Drawing Sheets

ADJUSTABLE REAR PISTOL SIGHT

CROSS-REFERENCE TO RELATED APPLICATIONS

This U.S. utility patent application claims priority, under 35 USC 119(e) and 120, to U.S. provisional patent application No. 60/750,051, filed Dec. 14, 2005. The disclosures of that application are expressly incorporated herein by reference.

FIELD OF THE INVENTION

The present invention is directed generally to an adjustable rear sight for a pistol. More specifically, the subject invention is directed to an adjustable rear pistol sight that is adjustable for both windage and elevation. Most specifically, the subject invention is directed to a windage and elevation adjustable rear pistol sight that is smooth, durable and compact in overall configuration and which is operable in a snag-free manner. The adjustable rear pistol sight includes a sight base and a sight block. The sight block is adjustable for windage and elevation through the provision of adjustment screws. There are no projecting portions of the screws, block or base. All edges are rounded and all corners are radiused to prevent any likelihood of the sight being apt to snag on holsters or clothing.

BACKGROUND OF THE INVENTION

A wide variety of optical sights are currently available for use on firearms such as handguns or pistols. A typical pistol has optical alignment fixtures or sights that include a front sight and a rear sight. These two sights can be aligned with one another to form a sight picture for aligning the pistol's point of aim on a target. Prior art pistol sights are usually mounted along the top edge of the pistol. Traditional semi-automatic pistols, such as, for example, the well known Colt™ model 1911, caliber .45, include a grip or handle carrying a lower receiver, a trigger mechanism and a slide member which is slidably supported on the lower receiver.

The traditional front sight is a vertically projecting blade or ramp-like member that is mounted at the front of the slide. The rear sight is adapted for mounting to the rear of the slide using a dovetailed transverse protrusion that mates with a corresponding transverse dovetailed slot in the slide.

Police officers and members of the armed forces require especially rugged sights on their weapons and so a genre of firearms and accessories adapted for "combat carry" has evolved to serve their special needs. These firearms must be durable, dependable and easy to operate. One requirement of such "combat carry" types of firearms is that the sights which they utilize not present a snagging hazard. It is clearly imperative that the pistol user must be able to unholster or to otherwise remove his pistol from its carry position and to place it in its use position without the possibility of the sight mechanism becoming caught on, or snagging a portion of the holster, an article of the user's clothing or a strap or other component of an article of equipment that he may be carrying. Even a momentary delay in the smooth transition of the pistol from a carry position to a use position can have fatal consequences.

The assignee of the present application previously developed a fixed sight which is intended to provide a smooth and snag-free draw, a clear sight picture and rugged service. That fixed sight is shown in Design Patent D447,205. Others, including gunsmith Wayne Novak, have also developed sights which are also intended to provide rugged service.

Such sights are often fitted in a transverse dovetailed notch formed in the rear of a pistol's slide and having standardized dimensions known in the industry as the "Novak notch" dimensions. By transverse is meant in a direction at a right angle to the pistol bore and lying in a horizontal plane when the pistol is held in a standard grip with the bore centerline in a horizontal plane. Generally, the standardized dimensions for the notch are selected so that the notch will accept a dovetail-like projection that is 12.5 millimeters in fore-aft length on a planar bottom surface and having sidewalls that taper inwardly at 70 degrees from horizontal on front and back wall surfaces. The bottom planar surface of the projection is preferably 3 mm in vertical height from the upper surface of the notch opening, within customary gunsmithing tolerances.

While the combat sights of the prior art do provide a somewhat smooth and snag-free draw, a clear sight picture and rugged service, they do not provide the adjustability many have come to enjoy when using target pistols equipped with adjustable target sights. Pistol sights are often used in a variety of situations. A sight is customarily optically aligned along the axis of the bore and is used to align the bore of the firearm with the target. Target sights are usually adjustable in the left and right direction for windage and in the up and down direction for elevation. A shooter will typically mount a sight to a firearm and will then immediately zero or sight-in the sight by a procedure of adjusting windage and elevation settings so that the sight's point of aim corresponds with the point of impact for a selected target at a desired range.

If a sight is mounted to a large caliber firearm, which is generating large recoil forces, or if the sight is subjected to rough handling, the zero or sighted-in position of the sight may change and the sight must then be adjusted for proper zero again. Traditional combat carry sights, as described above, are usually not adjustable for elevation, and so shooters have turned to permanently altering the front sight post by filing it down, to thereby raise the point of impact, or by substituting taller front sight blades, to lower the point of impact. Adjustments for windage have previously often required the shooter to strike the side of the sight with a pin punch and hammer, to thereby force the sight laterally in the notch, a clumsy and inherently inaccurate procedure that is clearly not well suited to making fine adjustments.

It will be readily apparent that a need exists for a rugged, durable, snag-free pistol rear sight that is adjustable for windage and for elevation and which overcomes the limitation of the prior art. The adjustable rear pistol sight in accordance with the present invention provides such a sight and is a substantial advance over the prior art.

SUMMARY OF THE INVENTION

It is an object of the present invention to provide an adjustable rear sight for a pistol.

Another object of the present invention is to provide an adjustable rear pistol sight that is adjustable for both windage and elevation.

A further object of the present invention is to provide an adjustable rear pistol sight that is smooth and durable and snag-free.

Yet a further object of the present invention is to provide an adjustable rear pistol sight which has no protruding elements.

Still another object of the present invention is to provide an adjustable rear pistol sight that is made of high-grade steel.

The aforesaid objects are achieved individually and in combination. It is not intended that the present invention be construed as requiring two or more of the objects to be combined unless expressly required by the claims attached hereto.

The adjustable rear pistol sight in accordance with the present invention is adapted to be received within a dovetail Novak-style notch in the pistol slide, in accordance with standard industry practice. The pistol sight thus includes a sight base having a bottom portion including a solid dovetail. The sight also includes a hinged and laterally movable sight block defining a sight notch. Both components are each machined from a solid piece of steel. The sight base provides a channel or bowl-like support defined by three protective vertical walls. This sight base is constructed to support and to protect the hinged and laterally movable sight block.

The sight picture of the assembled sight changes as the adjustable hinged and laterally movable sight block is adjusted. The sight block can be adjusted so that the assembled sight is symmetrical about a longitudinal sight axis that, when the sight is mounted on a pistol slide, is transverse to the dovetail and is parallel to the pistol bore.

The sight has a laterally movable longitudinal sight notch, in accordance with standard adjustable sight practice. The sight is adjustable, by the use of an elevation adjustment screw, situated on one lateral side of the sight, and by the use of a horizontal or windage adjustment screw situated on the other lateral side of the sight. Both conspicuously identify the adjustment functions of the hinged and laterally movable sight notch defining sight block and permit adjustment in elevation without requiring the shooter to file the front sight blade. Windage adjustments are also accomplished without requiring the shooter to use a drift punch on the sight body.

The sight assembly's sight base and sight block upper surface are defined on the left and right by radiused corners terminating in substantially vertical left and right side walls of the sight base. The rear surface of the sight base is angled or contoured forwardly from vertical, toward the pistol muzzle, and when viewed from the rear as during aiming, the sight base has a square-shaped recess machined into the angled rear surface to leave a substantially vertical recessed wall disposed symmetrically around and framing the longitudinal sight notch. The rear recess in the sight base is machined by a tool moving in a vertical square-shaped pattern lying in a plane that is parallel to the center axis of the dovetail and transverse to the sight's longitudinal axis, leaving the thickness of the resulting rear recess larger nearer the bottom of the sight base, and tapering to virtually no recess thickness nearer the top of the sight base. The sight base's upper surface tapers downwardly from rear to front terminating at the front edge in a front angled wall having the same angle as the front wall of the dovetail that is carried on the bottom of the sight base. The upper surface of the sight base also includes the bowl-shaped recess or channel which is disposed symmetrically about the sight assembly's longitudinal axis, to leave an open interior to support and protect the hinged and laterally movable sight block between vertical side walls. A set screw is partially concealed beneath the hinged and laterally movable sight block and is disposed in a threaded through-hole in the sight base and extending generally transversely to the longitudinal axis, through the dovetail of the sight base. This set screw is intended to be tightened by a user and to bear against the dovetail notch planar lower surface in the pistol slide. The sight notch runs longitudinally from a vertical rear wall of the hinged and laterally movable sight block to a front facing vertical wall defined in the hinged and laterally movable sight block. The recessed vertical rear wall of the sight base provides a large expanse of shadow or reflection-free background to aid in rapid sight alignment.

When mounted on a pistol slide, the sight assembly, in accordance with the present invention, provides a substantially smooth structure affixed in the pistol dovetail with windage and elevation adjustment screws for changing the position of the hinged and laterally movable sight notch formed in the sight block. The sight also features the vertical planar rear recessed wall machined into the rear of the sight base to frame the sight notch. As discussed above, the side walls of the sight base are radiused and rounded to essentially eliminate any possibility of the sight assembly of the present invention providing a snagging hazard.

The adjustable rear pistol sight in accordance with the present invention provides a windage and elevation sight assembly that is durable, smooth, dependable in operation and that has no exposed parts or non-flush elements which would form a snagging hazard. It is a substantial advance in the art.

BRIEF DESCRIPTION OF THE PREFERRED EMBODIMENTS

A full and complete understanding of the adjustable rear pistol sight, in accordance with the present invention, will be had by referring to the detailed description of the preferred invention, as set forth subsequently, and as seen in the accompanying drawings, in which.

DESCRIPTION OF THE PREFERRED EMBODIMENT

Figure 1:
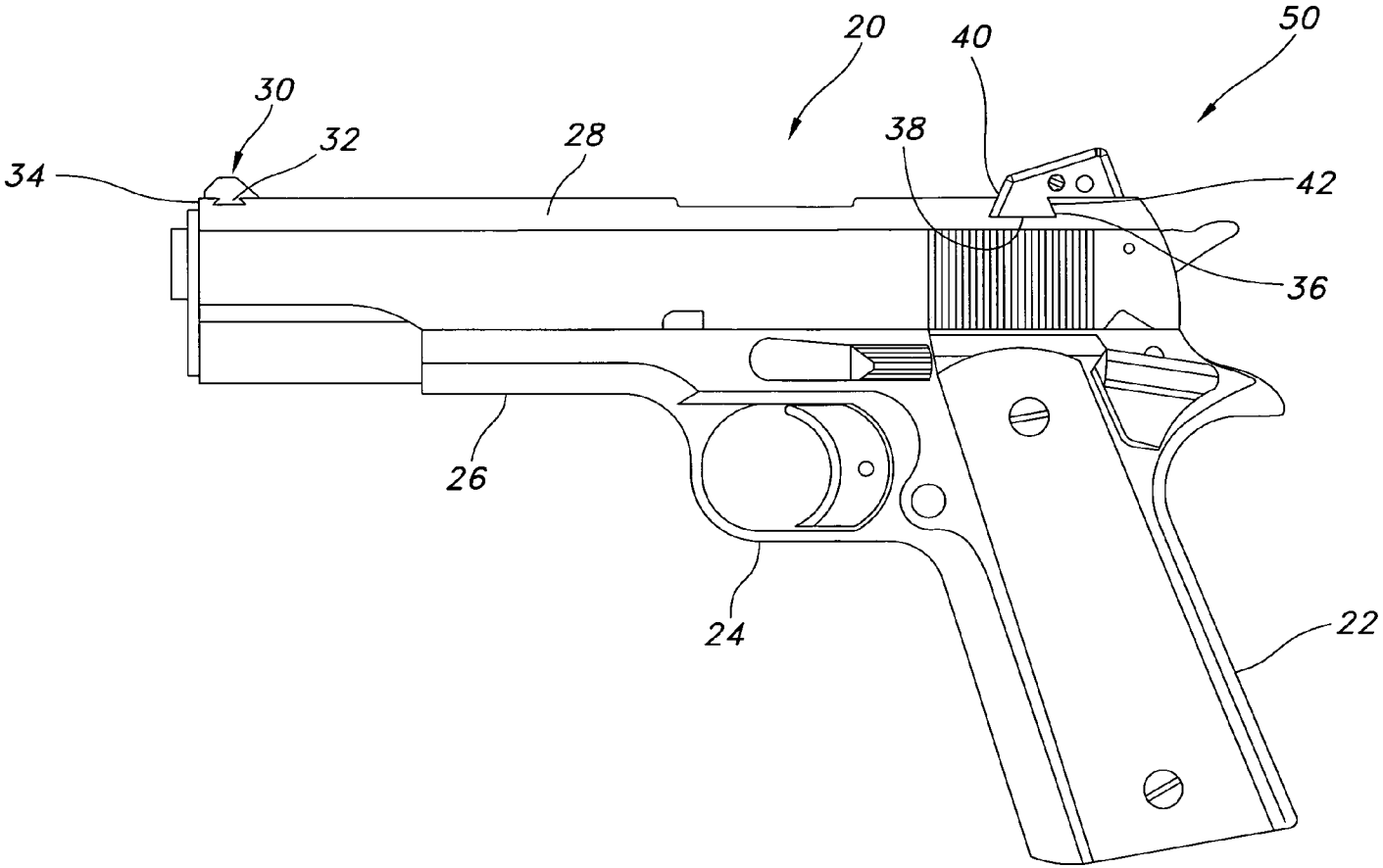
FIG. 1 is a schematic side elevation view of a pistol on which the adjustable rear sight of the present invention is mounted.

Referring initially to FIG. 1, there may be seen, generally at 20, a pistol with which the adjustable rear sight in accordance with the present invention is intended to be used. Pistol 20 includes a handle or grip 22, a trigger assembly 24, a receiver or body 26 and a slide 28. As is well known to those familiar with pistols, of which pistol 20 is intended to be exemplary of a large number of generally similar pistols, the upper slide 28 reciprocates in a longitudinal direction, with respect to the lower body 26, when the pistol is fired. The reciprocating motion is used to eject a spent casing and to chamber a live or fresh round. Such a longitudinal reciprocating motion is quite violent and is defined by rapid stoppage of the slide 28 and reversal of direction of slide travel. A front sight, generally at 30 is secured to the front of the slide 28. This is typically accomplished by sliding a lower front sight dovetail portion 32 into a front Novak-type transverse notch in the forward portion of the slide 28. The mounting of the front sight 30 is generally conventional and forms no part of the present invention. The pistol slide 28 is also provided with a rear Novak-type notch, generally at 36. As discussed previously, such Novak-type notches are generally known in this environment. They extend generally transversely to the longitudinal axis of the slide 28 and the bore of the pistol, which is not specifically shown. Such a Novak-type notch has a notch bottom 38 and front and rear, inwardly tapering notch walls 40 and 42, respectively. While the adjustable rear pistol sight in accordance with the present invention will be described hereinafter for use with a Novak-type rear slide notch, it will be understood that the rear sight of the present invention could, with only slight modifications, be adapted for use with slides having other configurations of rear notches or sight receiving apertures.

Figure 2:
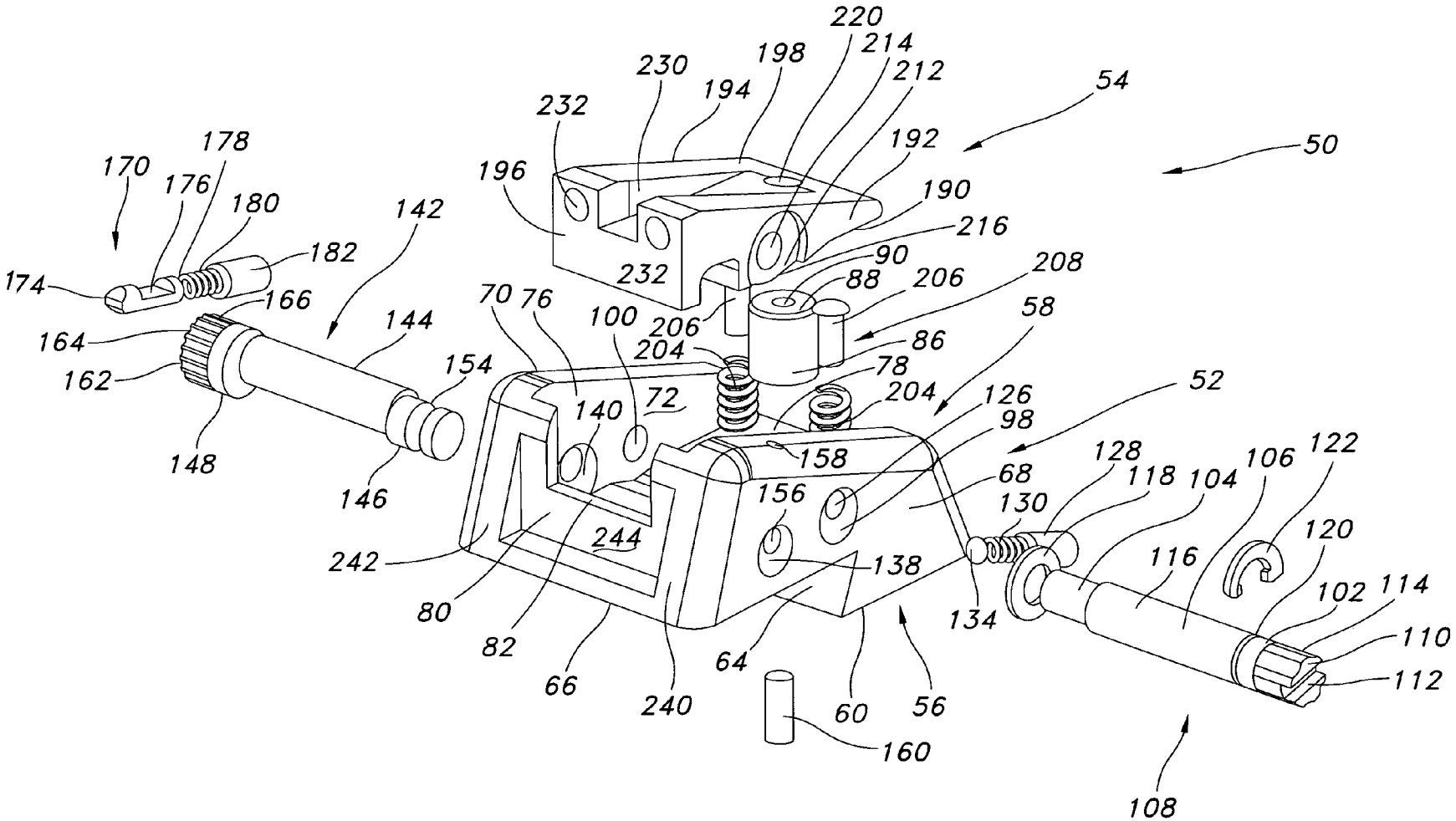
FIG. 2 is an exploded perspective view of the adjustable rear pistol sight of the present invention.

Referring now initially to FIG. 2, there may be seen generally at 50 an adjustable rear pistol sight in accordance with the present invention. Rear sight 50 is composed of two major components, a sight base 52 and a sight block 54. While both of these two components will initially be described somewhat separately, it will be understood that they function together to form the adjustable rear pistol sight, generally at 50, in accordance with the present invention.

Referring again to FIG. 2, the sight base 52 includes a lower sight base securement dovetail 56 and an upper sight base body 58. Sigh base dovetail 56 is located at a forward portion of sight base body 58 and depends generally downward therefrom. It will be understood, as discussed above, that dovetail 56 is depicted as being configured for use with a rear Novak-type notch 36 formed at the rear of a pistol slide 28. That notch 36 and slide 28 are only shown in FIG. 1 for clarity. Slide base dovetail 56 includes a planar dovetail bottom 60, a forward dovetail wall 62, and a rear dovetail wall 64. These dovetail walls 60 and 62 are sized and angled to be complementary to the notch front and rear walls 34 and 36, respectively of the rear Novak-type notch 36 that is formed in the slide 38 of the pistol. The sight base dovetail 56 slides into the slide rear notch 36 generally transversely to the longitudinal direction of the slide 28 and the pistol's bore and is fastened in place in a manner as will be discussed shortly.

Slide base body 58 is, as may be seen in FIG. 2, and also in various other ones of the drawings figures, generally rectangular and includes a sight base bottom 66, right and left sight base side walls 68 and 70, with the terms "right" and "left" referring to the view shown in FIG. 2 and being interchangeable with "first" and "second". The two side walls 60 and 62 of the sight base body 58 are spaced from each other, are generally parallel to each other and extend upwardly from the sight base body bottom 66. They define a hollow recess generally at 72 that is defined by inner surfaces 74 and 76 of the base body side walls 68 and 70, respectively. A recess floor 78 defines the lower extend of the sight base body recess 72. The recess floor 78 is generally parallel to the sight base body bottom 66, as may be seen more clearly in FIG. 5. A recess rear wall 80, that is provided with a rear wall aperture 82 completes the sight base body recess 72. It will be noted, as may be seen again more clearly in FIGS. 5 and 11 that the recess 72 does not have a front wall. The reason for this will be discussed in detail subsequently.

Figure 5:
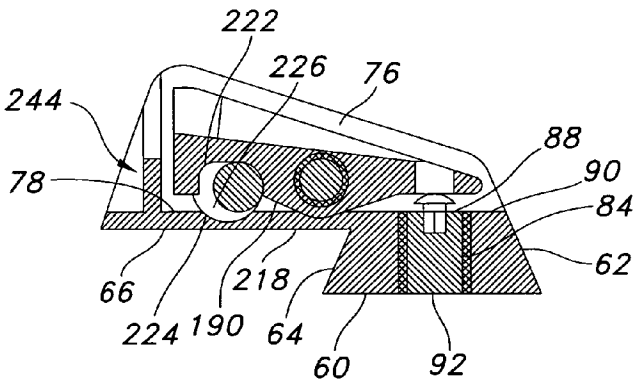
FIG. 5 is a side elevation view, partly in section, of the adjustable sight and taken along line V-V of FIG. 3.

A central threaded vertical passage 84 is formed on the recess floor 78 generally overlying the sight base dovetail 56 and extending from the recess floor 78 to the dovetail bottom 60, as may be seen more clearly in FIG. 5. A threaded set screw 86 is provided with an upper head 88 that has a hex key or allen key receptacle 90. The set screw 86 is threaded into the central threaded passage 84 before the sight base dovetail 52 is slid transversely into the slide rear Novak-type notch 36. As the set screw 86 is screwed down into the passage 84, a lower end 92 of the set screw 86 will engage the notch bottom 38. Continued tightening of the set screw 86 will elevate the dovetail 56 in the notch 36 to bring the dovetail walls 60 and 62 into firm engagement with the notch walls 40 and 42 respectively. Since the dovetail walls 60 and 62 and the notch walls 40 and 42 are complementarily angled, this engagement will positionally secure the sight base dovetail 58 in the slide rear notch 36. It will be understood that the sight base 52 will be secured centrally in the notch 36 so that the sight base side walls 68 and 70, as well as side walls of the notch do not extend laterally beyond the sides of the slide 28.

Figure 7:
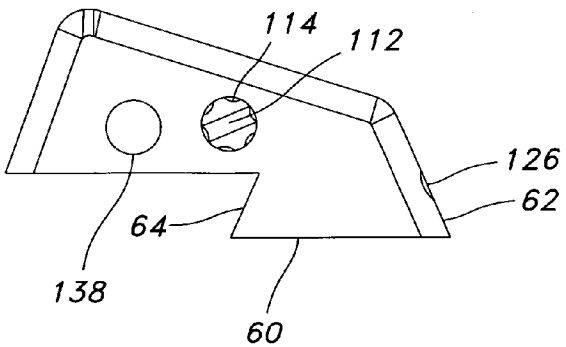
FIG. 7 is a side elevation view of the adjustable sight of FIGS. 2 and 3.

A forward pair of aligned apertures 98 and 100 are placed in the sight base body side walls 68 and 70, respectively, as may be seen in FIG. 2. These apertures are not threaded and are sized to rotatably receive proximal and distal portions 102 and 104, respectively of the shank 106 of a windage adjustment screw generally at 108. The right or first side wall forward aperture 98 is sized to receive a head 110 of the windage adjustment screw 108. As may be seen in FIG. 1 and also in FIGS. 7 and 8, the head 110 has a blade receiving slot 112 on its end surface and a plurality of axially extending flutes or grooves 114 on its periphery, for use in a manner that will be discussed shortly.

Figure 8:
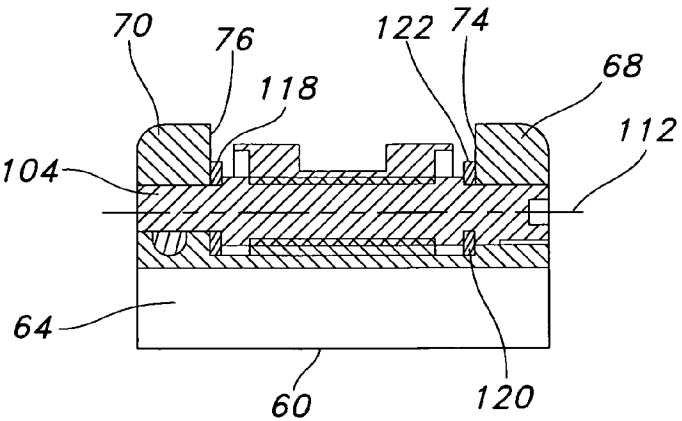
FIG. 8 is an end view, partly in section, of the adjustable sight taken along line VII-VIII of FIG. 3.
Figure 3:
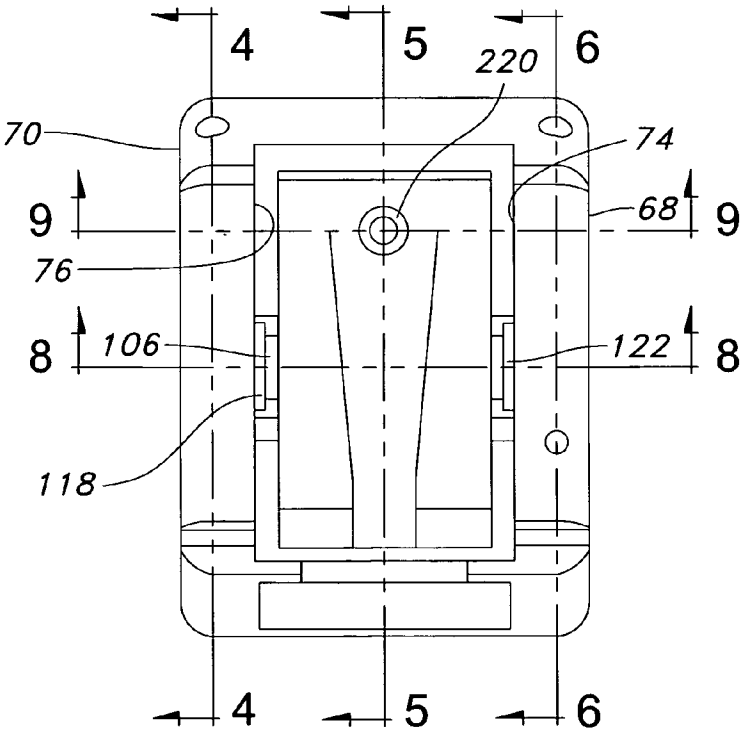
FIG. 3 is a top plan view of the adjustable rear pistol sight.

The distal end 104 of the shank 106 of windage adjustment screw 108 has a reduced diameter that terminates in a shoulder 116. The left or second forward aperture 100 has a diameter adapted to receive the reduced diameter distal end 104 of the windage adjustment screw shank 106. That reduced diameter is less than the diameter of the threaded central portion of the shank 106 of the windage adjustment screw 108. The overall length of the windage adjustment screw 108 is such that the distal end 104 and the head 110 are both received in their respective sight base body forward aperture 100 and 98, respectively and do not protrude out beyond planes defined by the side walls 70 and 68. A wave washer 118 is slid onto the distal, reduced diameter end 104 of the windage adjustment screw before that end is inserted into the aperture 100. The wave washer 118 is thus interposed between the interior surface 76 of the wall 70 and the shank shoulder 116 of the windage adjustment screw 108. A groove 120 is formed in the shank 106 of the screw 108 and is situated so that it will be just interior of the inner wall surface 74 of right or first sight base body wall 68. A snap ring 122 is inserted into the groove 120 once the windage adjustment screw 108 has been placed in its forward apertures 98 and 100. Snap ring 122, in its inserted position, is best seen in FIGS. 3 and 8, as is wave washer 118.

Figure 6:
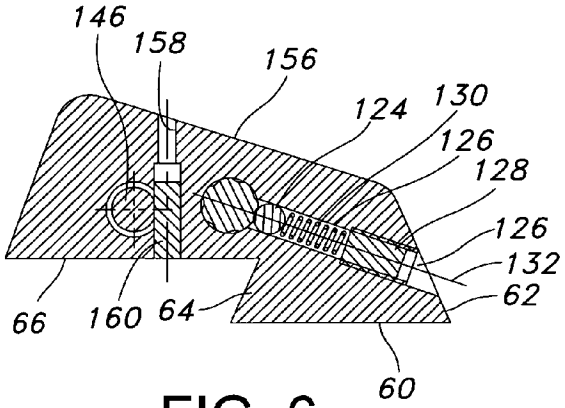
FIG. 6 is a side elevation view, in section, of the adjustable sight taken along line VI-VI of FIG. 3.

Rotation of the windage adjustment screw 108 is used to shift the sight block, generally at 54 laterally from side to side in the sight base body recess 72, as will be discussed in detail shortly. It is important that the windage adjustment screw have an audible and tactile detent so that the user can quantify an amount of adjustment which he accomplishes. Such an adjustment is done by inserting a screwdriver blade into the blade slot 112, and by then rotating the windage adjustment screw 108. Referring now to FIG. 6 and taken in conjunction with FIG. 2, a detent ball is insertable into a windage detent bore 126 that extends into the first or right side wall 68 of the sight base body 58 from the forward dovetail wall 62. The windage detent bore 126 is threaded along at least a portion of its length adjacent to the forward dovetail wall 62 and can receive a windage detent set screw 128. A coil spring 130 is interposed between the windage detent ball 124 and a distal end of the windage detent set screw 128. A screw driver blade slot 132 is formed in the proximal end of the windage detent set screw. As can be seen in FIG. 6, the windage detent bore 126 extends to the forward aperture 98 in its associated side wall 68. The windage detent ball 124 is sized to engage the flutes or grooves 114 in the windage adjustment screw 108. This provides both an audible "click" and a tactile feel as the windage adjustment screw 108 is rotated. The number of these "checks" can serve as a quantification of the amount of adjustment which has been imparted to the windage adjustment screw.

A pair of rear apertures 138 and 140 are placed in side walls 68 and 70 of sight base body 58, as may also be seen in FIG. 2. These rear apertures 138 and 140 receive an elevation adjustment screw 142 which functions in a manner that will be discussed more fully subsequently, to vary the elevation of the sight block 54 when it is positioned in place in the recess 72 in the sight base body 58. As may be seen in FIG. 2, the elevation adjustment screw 142 has a central eccentric shank 144 that is attached in an offset fashion to an elevation adjustment screw distal end 146 and to an elevation adjustment screw head 148. As may be seen most clearly in FIG. 11, an axis of rotation 150 of the eccentric central shank is offset from an axis of rotation 152 of the head 148 and the distal end of the elevation adjustment screw 142.

The elevation adjustment screw 142 is insertable into the rear apertures 138 and 140 of the walls 68 and 70 of the right and left or first and second side walls 68 and 70. The distal end 146 of the elevation adjustment screw 142 is provided with an annular groove 154. As may be seen most clearly in FIGS. 2 and 6, a vertical bore 156 extends upwardly into the right sight base body wall 68 from the base body bottom 66. This bore has a reduced diameter upper segment 158. A securement pin 160 is insertable into the vertical bore 156 from the base body bottom 66. A sidewall of that pin is received in the elevation screw distal shank annual groove 154 when that annular groove 154 is aligned with the pin 160. Any suitable means, such as adhesive or an interference fit can be used to hold the pin 160 in its bore 156. When the adjustable sight is in its use position, on the slide 28 of the pistol 20, the sight base body bottom 66 will overlie the slide 28 so that the slide 28 will prevent the pin 160 from backing out of its vertical bore 156. If needed, a drift pin or similar implement can be inserted through the reduced diameter upper section 158 of the vertical base 156 in the event that pin 160 needs to be dislodged.

Figure 4:
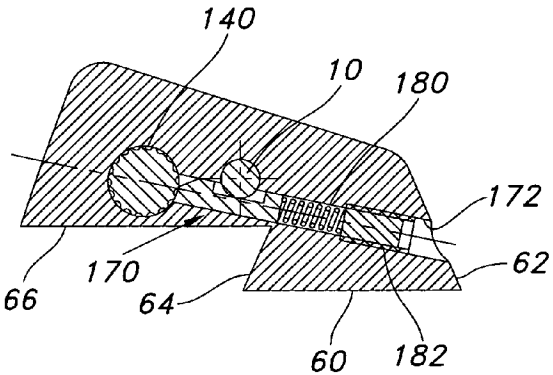
FIG. 4 is a side elevation view, in section, of the adjustable sight and taken along line IV-IV of FIG. 3.

Referring again to FIG. 2, and as may also be seen in FIG. 4, the head 148 of the elevation adjustment screw 142, which is technically not actually a screw, has a blade receiving slot 162 on its end face 164. A plurality of axially extending flutes or grooves 166 are placed on the periphery of the head 148 of the elevation adjusting screw 142. These flutes or grooves serve to provide an audible and tactile indication for a magnitude of the elevation adjustment imparted to the sight block 54 by rotation of the elevation adjustment screw 142. They also serve, as do the corresponding flutes or grooves 114 in the head 102 of the windage adjustment screw 108, to retain the respective screws in their adjusted portions.

Again referring to FIG. 4, taken in conjunction with FIG. 2, an elevation adjustment screw detent pawl 170 is receivable in an elevation detent bore 172. Pawl 170 has a toothed leading end 174 that is dimensioned to be receivable in a selected one of the elevation adjustment screw head flutes or grooves 166. A cut-out 176 is located in the pawl 170 intermediate its toothed leading end 174 and a spaced pawl trailing end 178. A coil spring 180, that is the same, in function, as the coil spring 130 used in the windage adjustment screw detent, is positioned between the pawl trailing end 178 and an elevation detent set screw 182 that is threaded into a threaded portion of the elevation detent bore 172. As may be seen in FIG. 4, the cut-out 176 of the elevation detent pawl 170 underlies the non-threaded distal end 104 of the windage adjustment screw 108. Thus, the pawl 170 and its associated coil spring 180 and set screw 182 must be in place before the windage adjustment screw 108 cam be installed.

The second major component of the adjustable rear pistol sight 50 in accordance with the present invention is the sight block, generally at 54. As may be seen most clearly in FIGS. 1 to 5 and 11, sight block 54 is somewhat wedge-shaped and has a sight block bottom 190 right and left or first and second sight block side walls 192 and 194, respectively, a sight block rear wall 196 and a sight block upper surface 198. The sight block upper surface and the sight block bottom 190 taper toward each other in the direction of the front of the sight block 54 to provide the sight block 54 with its wedge-shape.

Figure 9:
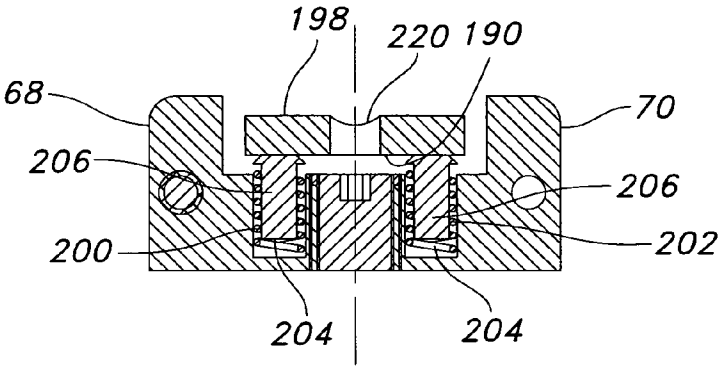
FIG. 9 is a sectional end view of the adjustable sight taken along line IX-IX of FIG. 3.

A pair of blind bores 200 and 202, as seen in FIG. 9 are formed in the sight base body 58 and extend into the sight base dovetail 56. Each of these blind bores 200 and 202 is closed at its lower terminus, again as seen most clearly in FIGS. 9 and 11. Each blind bore receives a coil biasing spring 204. A length of each such coil biasing spring 204 is greater than a depth of its corresponding blind bore 200 or 202. A biasing pin shank 206 of a biasing pin 208 is sized to be received within each biasing coil spring 204. Each such biasing pin 208 has an upper head 210 which is sized so that it will sit atop an upper end of the respective biasing coil spring 204 which receives that pin's shank 206. The two biasing pins 208 are thus biased upwardly and engage the bottom surface 190 of the sight block 54.

The sight block 54 is held in the recess 72 in the sight base body 58 by the passage of the threaded shank portion 106 of the windage adjustment screw 106 through a cooperatively threaded rocker sleeve 212 that is formed in the sight block 54. The threaded rocker sleeve 212 has a transverse threaded bore 214 into which the threaded central shank 106 of the windage adjustment screw is threaded. A lower arcuate surface 216 of the rocker sleeve 212 is supported in a forward transverse arcuate channel 218 that underlies the rocker sleeve 212 when the sight block 54 is positioned in the recess 72 in the sight base body 58. The forward end of the generally wedge-shaped sight block 54 is forced upwardly by the biasing pins 208 acting on the sight block bottom 190 forward of the axis of rotation of the sight block 54, which is defined by the threaded central shank 106 of the windage adjustment screw.

In passing, it is to be noted that the sight block 54 has a forward vertical passage 220. As may be seen in FIG. 3, this forward vertical passage 220 overlies the hex key or allen key socket 90 of the sight base securement set screw 86. This passage 220 is needed to allow the adjustable sight to be secured in place in, or removed from the Novak-type, or similar rear notch 36 in the pistol slide 28.

Figure 11:
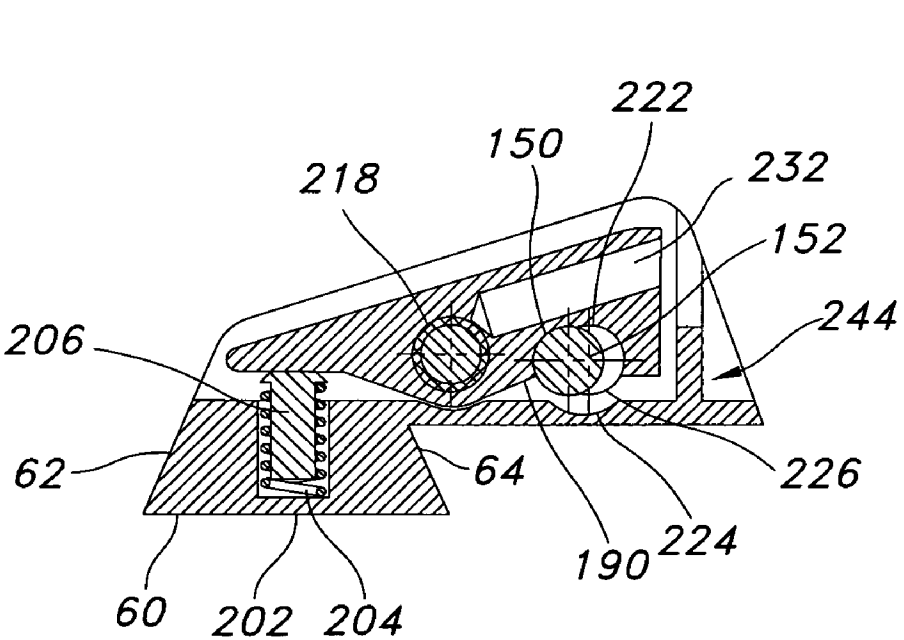
FIG. 11 is a side elevation view of the sight assembly shown in FIG. 10 and taken along line XI-XI of FIG. 10.

As may be seen in FIG. 2, and also in FIGS. 5 and 11, the sight block 54 also has a transverse rear elevation adjustment channel, generally at 222, and which is formed in the sight block bottom 190 to the rear of the transverse rocker sleeve 212. The rocker sleeve 212 thus acts as a fulcrum or pivot about which the sight block 54 can pivot in response to rotation of the elevation adjustment screw 142. The transverse rear elevation adjustment channel 222 overlies the central eccentric shank 144 of the elevation adjustment screw 142. That channel 222 overlies a correspondingly aligned floor recess 224 in the recess floor 78 of the sight base body 58. Together, the channel 222 and the floor recess 224 define an enlarged, transverse chamber 220 in which the central eccentric shank 144 of the elevation adjustment screw 142 can turn. As seen in FIGS. 5 and 11, when the eccentric shank 144 is in the position depicted in those figures, a rotation of the elevation adjustment screw in a clockwise direction, as viewed in FIG. 5 or in a counterclockwise direction, as viewed in FIG. 11, will lower the rear portion of the sight block 54 under the influence of the upward force exerted on the leading or front end of the sight block 54 by the biasing pins 208. Conversely, a rotation of the central eccentric shank 144 in the counterclockwise direction, as seen in FIG. 5, or in the clockwise direction, as seen in FIG. 11, will elevate the rear of the sight block 54 against the forces of the biasing pins 208. It will be understood that the dimension of the chamber 226 is sufficient to allow the central eccentric shank 144 of the elevation adjustment screw 142 to be rotated through 360° about its longitudinal axis 152 in response to rotation of the elevation adjustment screw head against the tactile and audible indication provided by the pawl 170.

The body of the sight block 54 includes a longitudinally extending sight notch, generally at 230. A forward portion of that sight notch 230 terminates at the forward vertical passage 220 in the sight block 54. The sight notch 230 terminates, at its rear, at the sight block rear wall 196. While the sight notch 230 is depicted as being generally rectangular or square in cross-section, it will be understood that other shapes are also suitable for the sight notch 230.

Figure 10:
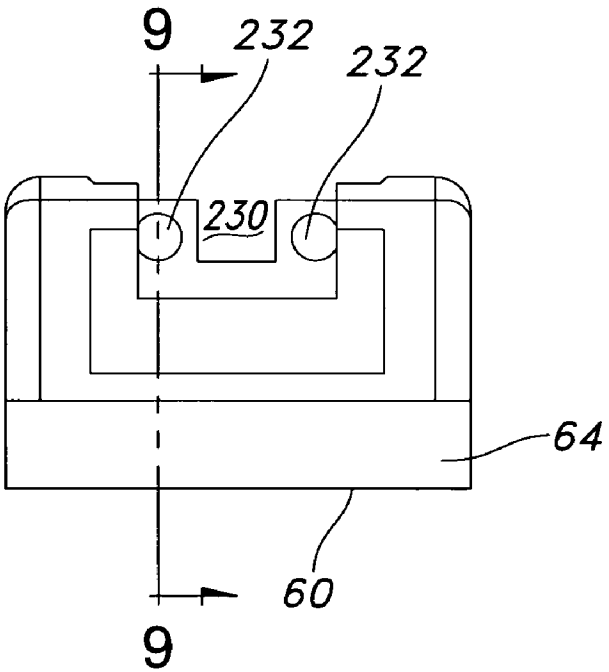
FIG. 10 is an end view of the adjustable sight of the present invention.

A pair of sources of luminescence, such as tritium vials 232 can be placed on either side of the sight notch 230 in the rear wall 196 of the sight block. These sources of luminescence are depicted as the typical tritium vials but could be arranged in configurations other than the two dots depicted in FIGS. 2 and 10. As is known in the art, the areas of luminescence on the rear wall 196 of the sight block 54 are typically usable with a source of luminescence in the front sight 30 to aid in the alignment of the front sight 30 centrally in the sight notch 230.

Referring again to FIGS. 2, 5, 10 and 11, the rear portion of the sight base body 58 includes the generally planar rear recess wall 80 and a pair of spaced rear base body walls 240 and 242. The rear base body walls 240 and 242 are angled forwardly as they extend up from the sight base body bottom 66 to the top of the sight base body right and left side walls 68 and 70, respectively. The result is the formulation of a rear sight base body recess 244. The surface of this rear recess 244 can be given a non-reflective, matte finish which will at least significantly reduce, if not completely eliminate reflective glare that might otherwise interfere with the effective use of the adjustable sight 50 in accordance with the present invention.

In operation, the assembled sight 50, with the set screw 86 at least partially screwed into the central threaded passage 84, is slid laterally or transversely, with respect to the longitudinal axis of the slide 28, into the rear Novak-type notch 36, or other similar aperture in the slide 28. Once the sight 50 has been centrally situated in that rear notch, the set screw 86 is tightened down to secure the adjustable sight 50 firmly in place, as was discussed previously. The elevation and windage of the sight 50 can now be adjusted during a sighting-in or zeroing process that is generally known to those of skill in the art. The windage is adjustable by rotation of the windage adjustment screw 108. The threaded central shank 106 of that screw 108 is received in the transverse threaded bore 214 in the rocker sleeve 212 of the sight block 54. Rotation of the windage adjustment screw 108 will thus shift the sight block 54 laterally in the sight base body recess 72 in one direction or the other, depending on the direction of rotation of the windage adjustment screw.

Elevation adjustment of the sight block 54 is accomplished by rotation of the elevation adjustment screw or shaft 142. As described previously, the central eccentric shank 144 of screw or shaft 142 is movable in the chamber 226 defined by the cooperating sight block and sight base body. Both the adjustment screws 108 and 142 are each held in a desired adjusted position by their respective detent mechanisms, as was described previously.

As may be seen in a number of the accompanying drawings, the corners of the sight base body 58 are all rounded or radiused. This has been done to insure that the finished and assembled sight 50 has a smooth outer finish which will not snag or become caught. The sight block 54 is situated within the confines of the sight base body recess 72. The heads and distal ends of the windage adjustment screw 108 and of the elevation adjustment screw 142 are flush with the side walls 68 and 70 of the sight base body 58. The front portion of the base body 58 transitions into the front wall 62 of the sight base dovetail 56. The result, as has been discussed above, is an adjustable sight with windage and elevation capabilities that is durable, that has a smooth snag-resistant exterior and that has a clean, uncluttered overall appearance.

The two major components of the adjustable sight in accordance with the present invention are each machined from high quality materials such as tool-grade steel or the like. Sophisticated machining processes, such as EDM machining are employed to form each of the sight base and the sight body out of a single piece of metal. The result is an adjustable sight that is well-suited to the rigorous service demands placed on it by law enforcement and military forces while still providing the windage and elevation adjustment capabilities that have come to be associated with high-end equipment.

While a preferred embodiment of an adjustable rear pistol sight, in accordance with the present invention, has been set forth fully and completely hereinabove, it will be apparent to one of skill in the art that various changes could be made without departing from the true spirit and scope of the present invention which is accordingly to be limited only by the appended claims.

What is claimed is:

1. An adjustable rear sight adapted for use on a slide of a pistol, said adjustable rear sight comprising:

a sight base including a sight base dovetail and a sight base body, said sight base dovetail having a planar dovetail bottom and tapered dovetail front and rear walls, said sight base body being formed integrally with said sight base dovetail;

a sight base body recess in said sight base body, said sight base body recess being defined by first and second sight base body sidewalls, a sight base body recess bottom and a sight base body recess rear wall;

a sight block supported for translational and pivotable movement in said sight base body recess, said sight block including a sight block bottom, spaced sight block side walls, a sight block rear wall and a sight block upper surface;

a sight notch in said sight block and extending from a front edge of said sight block to said sight block rear wall;

a windage adjustment screw threadably secured in said sight block and rotatably supported in said first and second sight base body side walls; and an elevation adjustment screw rotatably supported in said sight base body first and second walls and having an eccentric adjustment shank positioned between said sight block bottom and said sight base body recess bottom.

2. The adjustable rear sight of claim 1 further including a threaded rocker sleeve in said sight block, said windage adjustment screw having a threaded shank received in said threaded rocker sleeve.

3. The adjustable rear sight of claim 2 wherein said threaded rocker sleeve is formed in said sight block intermediate said sight block front edge and said sight block rear wall and having a lower arcuate surface forming a part of said sight block bottom.

4. The adjustable rear sight of claim 3 further including a forward transverse arcuate channel in said sight base body bottom, said sight block lower arcuate surface being receivable in said sight base body forward transverse arcuate channel.

5. The adjustable rear sight of claim 2 further including biasing means positioned in said sight base body and in engagement with said sight block.

6. The adjustable rear sight of claim 5 wherein said biasing means is engagable with said sight block on a first side of said threaded rocker sleeve and said eccentric adjustment shank is engagable with said sight block on a second side of said threaded rocker sleeve.

7. The adjustable rear sight of claim 1 further including a bottom recess in said sight base body recess bottom and a transverse rear elevation adjustment channel in said sight block, said bottom recess and said rear elevation adjustment channel defining a transverse chamber, said eccentric adjustment shank being received in said transverse chamber.

8. The adjustable rear sight of claim 1 further including a windage adjustment screw detent including a detent ball and a fluted head on said windage adjustment screw, said detent ball engaging a selected one of said windage adjustment screw head flutes.

9. The adjustable rear sight of claim 8 further including a windage detent bore in one of said first and second sight base body side walls, said detent ball being positioned in said windage detent bore.

10. The adjustable rear sight of claim 1 further including an elevation adjustment screw detent including a pawl and a grooved head of said elevation adjustment screw, said pawl engaging a selected one of said elevation adjustment screw head grooves.

11. The adjustable rear sight of claim 10 further including a toothed pawl end in engagement with said selective one of said elevation adjustment screw head grooves.

12. The adjustable rear sight of claim 10 further including an elevation adjustment screw detent bore in one of said first and second sight base body side walls, said detent pawl being positioned in said elevation adjustment screw detent bore.

13. The adjustable rear sight of claim 1 further including a central threaded passage in said sight base body and dovetail, a set screw threadably received in said central threaded passage and a forward vertical passage in said sight block and overlying a head of said set screw.

14. The adjustable rear sight of claim 1 further including first and second transversely aligned forward apertures in said first and second sight base body side walls and proximal and distal ends of said windage adjustment screw positioned in said first and second forward apertures.

15. The adjustable rear sight of claim 14 further including a wave washer on said distal end of said windage adjustment screw intermediate said sight block side wall and said adjacent sight base body side wall.

16. The adjustable rear sight of claim 5 wherein said biasing means includes spaced blind bores in said sight base body, coil springs positioned in each of said blind bores and a biasing pin positioned intermediate each said coil spring and said sight block bottom.

17. The adjustable rear sight of claim 16 wherein each said biasing pin includes a bearing pin shank receivable in each said cooperating one of said coil springs and a biasing pin head in engagement with said sight block bottom.

18. The adjustable rear sight of claim 1 wherein each said sight base and said sight block is a one piece, unitary element.

19. The adjustable sight assembly of claim 1 further including edges between said sight base body side walls and rear wall, said edges being radiused.

20. The adjustable rear sight of claim 1 wherein said sight block is wedge-shaped.

* * * * *